US012643635B2

(12) United States Patent
Foster et al.

(10) Patent No.: US 12,643,635 B2
(45) Date of Patent: Jun. 2, 2026

(54) MOORING ARRANGEMENT FOR A TENSION LEG PLATFORM

(71) Applicant: Marine Power Systems Limited, Swansea (GB)

(72) Inventors: Graham Foster, Swansea (GB); Alex O'Malley, Swansea (GB)

(73) Assignee: MARINE POWER SYSTEMS LIMITED, Swansea (GB)

( * ) Notice: Subject to any disclaimer, the term of this patent is extended or adjusted under 35 U.S.C. 154(b) by 67 days.

(21) Appl. No.: 18/480,891

(22) Filed: Oct. 4, 2023

(65) Prior Publication Data

US 2024/0034439 A1 Feb. 1, 2024

Related U.S. Application Data

(63) Continuation of application No. PCT/EP2022/059277, filed on Apr. 7, 2022.

(51) Int. Cl.
*B63B 21/50* (2006.01)
*B63B 35/44* (2006.01)

(52) U.S. Cl.
CPC ..... *B63B 21/502* (2013.01); *B63B 35/44* (2013.01); *B63B 2035/446* (2013.01)

(58) Field of Classification Search
CPC .. B63B 21/502; B63B 2021/505; B63B 35/44
See application file for complete search history.

(56) References Cited

U.S. PATENT DOCUMENTS 8,657,534 B2 * 2/2014 Jahnig ..... B63B 21/502 405/223.1
10,252,777 B2 * 4/2019 Hardcastle ..... B63B 75/00
(Continued)

FOREIGN PATENT DOCUMENTS

CN 211874639 U 11/2020
CN 112027006 12/2020
(Continued)

OTHER PUBLICATIONS

International Search Report and Written Opinion of the International Searching Authority for PCT/EP2022/059277, Jul. 28, 2022, 14 pages.

(Continued)

*Primary Examiner* — Sean D Andrish
(74) *Attorney, Agent, or Firm* — Heslin Rothenberg Farley & Mesiti P.C.

(57) ABSTRACT

A buoyant tension leg platform arranged to support a renewable energy capturing device when the platform is submerged in a body of water. The platform has at least three vertices or lateral extents, at least three of the vertices or lateral extents have a mooring arrangement. The mooring arrangement includes a first mooring line extending between the vertex or lateral extent and a first anchor point in communication with a bed of the body of water. The first mooring line extends at an angle relative to the bed and a second mooring line extending from the vertex or lateral extent to a second anchor point. The second mooring line extends at an angle relative to the bed, such that the mooring arrangement of the corresponding vertex or lateral extent defines a triangle.

10 Claims, 8 Drawing Sheets

(56) References Cited

U.S. PATENT DOCUMENTS

| | | | | |
|---|---|---|---|---|
| 2013/0276687 | A1 | 10/2013 | Roddier et al. | |
| 2019/0078556 | A1 * | 3/2019 | Stiesdal | B63B 21/502 |

FOREIGN PATENT DOCUMENTS

| | | | | |
|---|---|---|---|---|
| CN | 112032002 | | * | 12/2020 |
| EP | 2789849 | A1 | | 10/2016 |
| FR | 2290346 | | * | 11/1974 |
| FR | 2967470 | | | 5/2012 |
| GB | 2240737 | A | | 11/2012 |
| GB | 2490737 | | | 11/2012 |
| JP | 2019104420 | A | | 6/2019 |
| WO | 2013040871 | A1 | | 3/2013 |
| WO | 2013084633 | A1 | | 6/2013 |
| WO | 2019229476 | | | 12/2019 |

OTHER PUBLICATIONS

Chilean Search Report from Chilean Patent Office for Chilean Application No. 202302993 dated Mar. 10, 2025, 3 pages.
European Examination Report for European Application No. 22721681.9 dated Jun. 3, 2025, 10 pages.
Notice of Reasons for Rejection of the Japanese Patent Office for JP 2023-558778, mailed on Apr. 16, 2026.

* cited by examiner

MOORING ARRANGEMENT FOR A TENSION LEG PLATFORM

CROSS REFERENCE TO RELATED APPLICATIONS

This continuation application claims priority benefit from International Application No. PCT/EP2022/059277 filed on Apr. 7, 2022, which claimed priority from Great Britain Application No. 2104934.1 filed Apr. 7, 2021, which are both incorporated herein by reference in their entirety.

FIELD OF THE INVENTION

The present disclosure relates to a renewable energy system mounting platform, and in particular to a tension leg platform arranged to support a renewable energy harnessing device while submerged in a body of water.

BACKGROUND OF THE INVENTION

A tension leg platform (TLP) refers to a type of marine platform and mooring arrangement in which a buoyant platform is constrained by tensioned mooring lines. The buoyancy acting vertically against the mooring lines stabilises the platform above the point at which the moorings are anchored.

Traditionally TLPs comprise vertical mooring lines; this arrangement gives very good stiffness and therefore stability control in the vertical (heave) direction but, depending on the length of the mooring lines, the horizontal (surge) stiffness and therefore positional control is less favourable.

Positional stability is a requirement for renewable energy harnessing devices such as wind turbines and wave energy converters that may be mounted on a marine platform. Generally, all such machines will have limits on motional factors such as excursions, accelerations and tilts before performance is compromised or damage is risked.

Therefore, mooring arrangements that improve the stability of TLPs over and above the traditional vertical layout are desirable to increase the feasibility of using TLPs for mounting renewable energy devices or other systems.

SUMMARY OF THE INVENTION

The present disclosure is directed to a buoyant tension leg platform (TLP) and a mooring arrangement for the platform. The buoyant platform has at least three vertices, or lateral extents, each of the at least three vertices or lateral extents having a mooring arrangement. The mooring arrangement is configured to triangulate each vertex, or lateral extent, of the platform with a bed of a body of water in which the platform is submerged. Such triangulation has been found to improve stability of the platform in a submerged operating state, due to an increase in a rate of submergence of the buoyancy of the platform in response to lateral offsets as a result of wave forces acting on the platform. Therefore, a horizontal (surge) stiffness of the platform is improved substantially by the present mooring arrangement. Such stability in the platform has been found to be advantageous to the continued and uninterrupted capture of renewable energy by a renewable energy harnessing device mounted on the platform, together with improved robustness to wave forces acting thereon and therefore to improved overall longevity of a renewable energy capturing system. Such improved longevity has been found to be beneficial particularly due to the remoteness of such systems, and the logistical requirements when considering necessary maintenance and repairs to such systems.

In accordance with an aspect of the present disclosure, there is provided a buoyant tension leg platform arranged to support a renewable energy capturing device when the platform is submerged in a body of water, the platform having at least three vertices or lateral extents, at least three of the vertices or lateral extents having a mooring arrangement; wherein the mooring arrangement comprises: a first mooring line extending between the vertex or lateral extent and a first anchor point in communication with a bed of the body of water, the first mooring line extending at an angle relative to the bed; and a second mooring line extending from the vertex or lateral extent to a second anchor point, the second mooring line extending at the angle relative to the bed, such that each mooring arrangement of a corresponding vertex or lateral extent defines a triangle positioned on a plane.

By triangulating each vertex or lateral extent of a TLP with more than one angled line the stability of the TLP is improved as the rate of submergence of the buoyancy is increased in response to lateral offsets. Therefore, the horizontal (surge) stiffness of the TLP is increased substantially.

In the context of the present disclosure, the term "a body of water", will be understood by the skilled addressee to mean any suitable body of water, and is particularly directed to a sea or an ocean.

The angle at which both the first and second mooring lines are oriented relative to the bed of the body of water are the same, such that each mooring arrangement of a corresponding vertex or lateral extent defines a triangle positioned on a plane. This triangulation of the vertices or lateral extents to the sea bed provides the necessary improvement to the surge stiffness of the TLP, thereby providing an improvement in stability of the platform.

In some embodiments, the first and second mooring lines of a mooring arrangement may be positioned at 45° relative to the seabed. This arrangement has been found to have particularly beneficial effects on platform stability. Further, some features have been found to include a positioning of the first and second mooring lines of the mooring arrangement at 90° relative to one another, again for improved stability.

In some embodiments, the first anchor point and the second anchor point are positioned equidistant from a central axis of the mooring arrangement, the central axis extending vertically from the corresponding vertex or lateral extent of the mooring arrangement. In most embodiments the anchor points will be understood to be fixed points via which the platform is tethered to a bed of the body of water by the mooring lines.

In some of the disclosed embodiments, the planes of each of the triangles formed by the mooring arrangements are parallel. The parallel planes may preferably be oriented perpendicular to a most common wave direction and/or a most common wind direction. Planes arranged perpendicular to a common wave and/or wind direction have been identified to provide surprising robustness to surge forces. In many locations it may be possible to anticipate a prevailing wind and/or wave direction to be experienced by the platform and any renewable energy harnessing device mounted thereon. In order to provide optimum stability in such embodiments, it may be preferable to arrange the planes perpendicular to the direction. Such a "most common" direction may, in some embodiments, be determined ahead of deployment to inform the plane orientation.

In some embodiments, the planes of each of the triangles formed by the mooring arrangements intersect a plane of a different triangle. The intersecting nature of the planes of the mooring arrangements in such embodiments preferably provides robustness to surge in multiple directions, and may therefore be preferable for embodiments to be deployed in locations expected to have varying wind and/or wave directions over time. In some embodiments, the planes may intersect to form an intersect angle, wherein a sum of all the intersect angles of the platform equals approximately $(n-2)\times 180°$ (where n is the number of vertices of the platform). It will be understood that the intersect angle refers to the internal angle of the plane intersect proximate the platform. In such embodiments, the intersect angles are preferably the same. For example, in an embodiment having three vertices, the planes of the triangles formed by the mooring arrangements of the three vertices may be positioned such that they intersect, each intersection forming an equal angle of approximately 60°. In some embodiments having planes arranged to intersect, the planes may be tangential to the corresponding vertex of the platform.

In some embodiments, each mooring arrangement preferably comprises more than two mooring lines. In such embodiments, each of the more than two mooring lines may be affixed to a corresponding anchor point, the anchor points of each mooring arrangement defining vertices of a regular two dimensional shape, each anchor point being equidistant from a centre of the shape. In some of the embodiments, the centre of the shape is in vertical alignment with the corresponding platform vertex or lateral extent of the mooring arrangement forming the shape. The term "in vertical alignment with the corresponding platform vertex or lateral extent" will be understood in the context of the present disclosure to mean positioned directly below the platform vertex or lateral extent, and may additionally be referred to as horizontally aligned with the vertex or lateral extent on a plane vertically below that of the vertex or lateral extent.

Preferably the mooring lines comprise a mooring line material, the mooring line material being one or more selected from the group: chain; rope. The mooring line material is preferably rust resistant. In embodiments wherein the material is a chain, the chain may comprise, or be formed of, steel or an alloy comprising steel. In embodiments wherein the material is a rope, the rope may be formed or a metal, for example a plurality of metal wires, which may comprise, or be formed of, for example steel or an alloy comprising steel. In some embodiments, the rope may be a synthetic rope, wherein examples of a suitable synthetic material may be nylon and dyneema. Embodiments will be appreciated wherein the mooring line material is any suitable material for providing a tension leg platform.

The platform preferably further comprises a buoyancy member positioned on or adjacent each vertex or lateral extent. The buoyancy member preferably defines a centre of buoyancy of the corresponding vertex or lateral extent, wherein the centre of buoyancy is preferably positioned on the central axis of the corresponding mooring arrangement. The buoyancy member may in some embodiments be arranged to provide an adjustable buoyancy of the vertex or lateral extent.

The mooring arrangement is preferably configured to hold the platform in a submerged position within the body of water. In some embodiments, the platform may comprise an upper portion positioned above the surface of the water in the submerged position. The upper portion may support a renewable energy capturing device.

In accordance with a further aspect of the present disclosure, there is provided a mooring arrangement for use with a platform of the first aspect.

It will be appreciated that any features described herein as being suitable for incorporation into one or more aspects or embodiments of the present disclosure are intended to be generalizable across any and all aspects of the disclosure.

BRIEF DESCRIPTION OF THE DRAWINGS

The accompanying drawings, which are incorporated in and constitute a part of the specification, illustrate embodiments of the disclosure and together with the detailed description herein, serve to explain the principles of the disclosure. It is emphasized that, in accordance with the standard practice in the industry, various features are not drawn to scale. In fact, the dimensions of the various features may be arbitrarily increased or reduced for clarity of discussion. The drawings are only for purposes of illustrating preferred embodiments and are not to be construed as limiting the disclosure.

DETAILED DESCRIPTION FOR CARRYING OUT THE INVENTION

In this detailed description and the following claims, the term "vertices" will be understood to mean major "lateral vertices" formed at the peripheral edge of the platform, with the number of vertices being governed by the primary two-dimensional cross-sectional shape describing the platform, which is preferably a regular polygon. For example, a platform having a largely triangular shape will be understood to have three vertices. The present disclosure will be understood to be suitable for use with a platform having any number of the vertices. In a platform having more than three vertices, it will be understood that at least three of the vertices comprise a mooring arrangement. Vertices having a mooring arrangement will preferably be equispaced about the periphery of the platform, and at approximately equal distance from a centre of the platform. In the context of the present disclosure, the term "lateral extents" will be understood to be interchangeable with the term "vertices" and is intended to mean points on, or regions of, the platform located about the outer edge of the platform or positioned distal to a centre of the platform. Any mention herein of the terms "vertex" or "vertices" is intended to also include within its meaning, "lateral extent" or "lateral extents" respectively. Examples of such vertices or lateral extents include the major vertices on a polygon, or an end of an elongate structure or member extending away from proximate the centre of the platform. Such elongate structures may for example extend radially outward from proximate the centre of the platform such as in a star or sunburst configuration. In most embodiments, each of the vertices or lateral extents of a platform comprises the mooring arrangement.

Figure 1A:
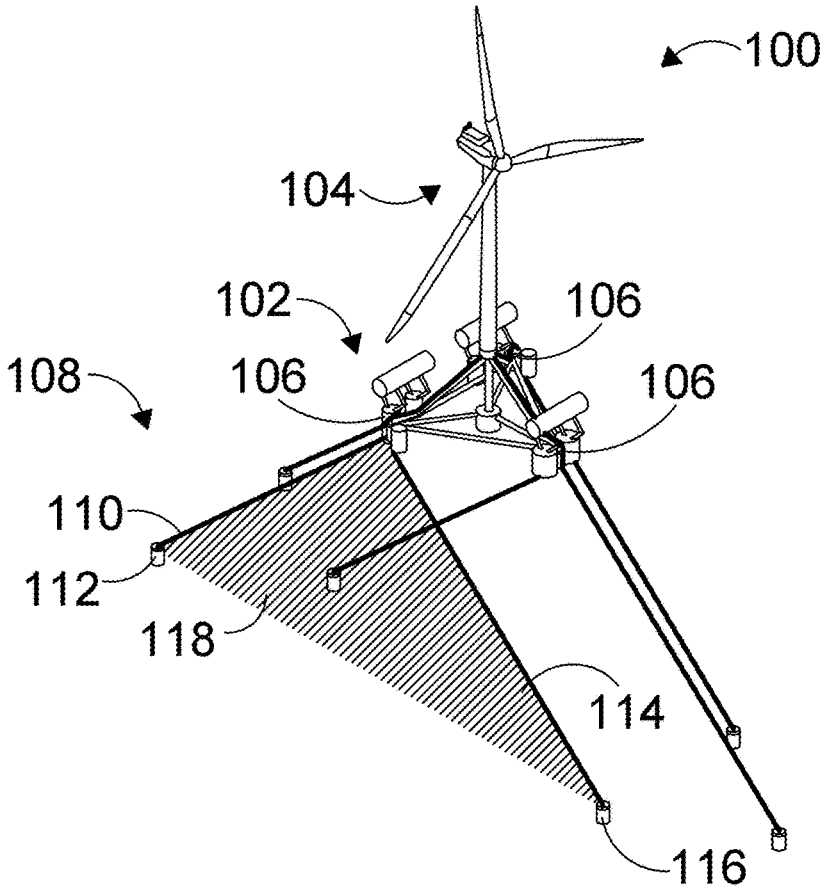
FIG. 1A depicts a perspective view of a platform in accordance with the first aspect of the disclosure having a wind turbine mounted thereon and a mooring arrangement of the second aspect having planes arranged in parallel, in use in a submerged operating configuration, wherein the platform comprises three vertices, in accordance with an aspect of the present disclosure.

With reference to FIG. 1A, there is illustrated an embodiment 100 of a buoyant platform of the first aspect of the present disclosure, in use, tethered in a submerged operating configuration to a bed of a body of water by mooring arrangements in accordance with the second aspect to form a tension leg platform (TLP). In the example embodiment shown, the platform 102 comprises a substantially planar lower portion, and an upper portion extending therefrom which remains above a surface of the body of water and comprises a wind turbine 104 mounted thereon. A lower portion of the platform supports a series of wave energy converters (WECs). Other embodiments will be appreciated wherein the platform is any suitable buoyant structure arranged to support any suitable renewable energy capturing or harnessing device.

The platform 102 in the embodiment of FIG. 1A comprises an open metal framework forming a generally triangular structure having three vertices 106. Extending from each of the vertices 106 and toward the bed of the body of water (which in the present example case is a sea or ocean) is a mooring arrangement 108 of the second aspect. The mooring arrangement 108 comprises a first mooring line 110 tethered to the bed of the body of water at a first anchor point 112, and a second mooring line 114 tethered to the bed of the body of water at a second anchor point 116, the mooring arrangement 108 therefore forming a triangle 118 positioned in a substantially vertical plane. In the embodiment shown, the triangle shape formed by each of the mooring arrangements 108 of the corresponding vertex 106 are positioned in parallel planes, as shown in the plan view of FIG. 1B.

The body of water, and other internal and external sources, will subject the platform 102 to numerous forces and moments, in use. It is desirable for the platform 102 to remain stable in use so that, for example, sustained optimal renewable energy capture can occur, and additionally so that damage to, or in extreme cases toppling of, the platform 102 does not occur. The tension in the mooring lines 110, 112 allows the three vertices of the platform 102 to remain in a relatively fixed plane, substantially parallel to the surface of the body of water during subjecting of the platform 102 to forces and moments by, for example, waves and wind. In this way, the mooring arrangements 108 provide stability to the platform 102.

In the example shown, each vertex 106 of the platform 102 comprises a pair of buoyancy tanks. A downward gravitational pull acting on the platform 102 supporting the turbine 104 is therefore exceeded by an upward buoyant force of the platform 102 provided by the buoyancy tanks. The buoyancy tanks provide the predominant net positive upward buoyant force to the platform 102. In the example shown, for each vertex 106 of the platform 102, each of a pair of the buoyancy tanks are positioned equidistant from a central vertical axis of the corresponding vertex 106, providing a combined centre of buoyancy of the vertex 106 at the axis. Therefore, in the submerged operating mode shown, the mooring lines 110, 114 of the mooring arrangements 108 are under tension from the upward buoyancy force acting thereon, therefore providing a tension leg platform (TLP).

In the submerged operating configuration of the platform 102 shown, the first mooring line 110 and the second mooring line 114 are positioned relative to the bed of the body of water at the same internal angle, which in the example embodiment shown is 45°. The first mooring line 110 and the second mooring line 114 are positioned relative to one another at an internal angle of 90° in the example embodiment shown. In the example embodiment, the apex of the triangle 118 formed at the corresponding vertex 106 is positioned vertically aligned with a centre point of the hypotenuse of the triangle 118 tracking along the bed of the body of water between the first anchor point 112 and the second anchor point 116. Therefore, the anchor points 112, 116 are equidistant from the central vertical axis of the corresponding vertex 106, which in the example shown places the anchor points 112, 116 equidistant from a centre of buoyancy of the corresponding vertex 106.

Figure 1B:
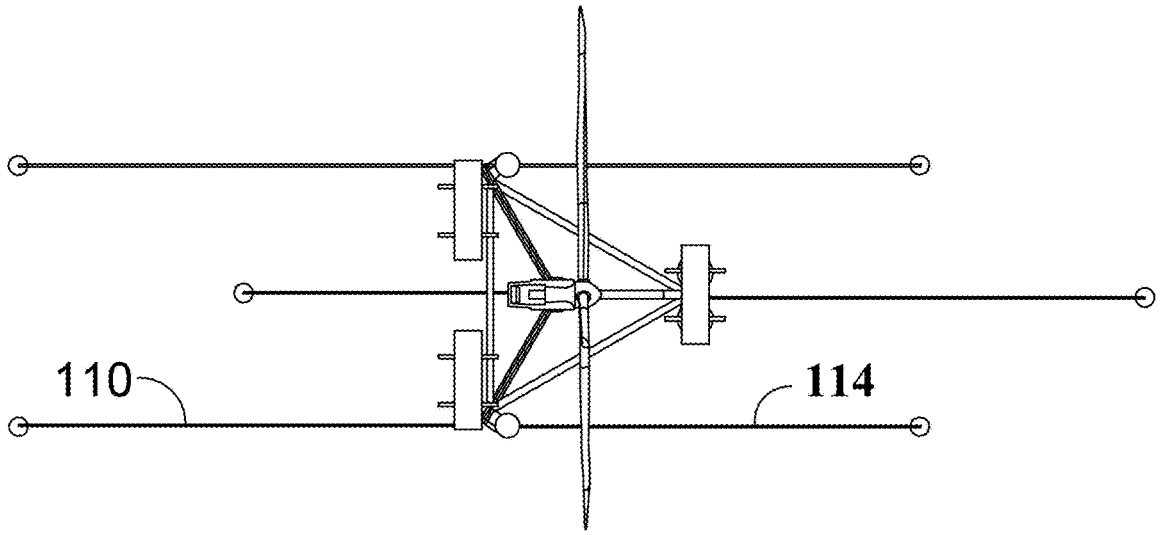
FIG. 1B depicts a plan view of the invention of FIG. 1A, in accordance with an aspect of the present disclosure.

The positioning of the mooring arrangements 108 of the multiple vertices in parallel planes in the example embodiment, as shown in the plan view of FIG. 1B, is performed having knowledge of the predominant wave direction at the location at which the embodiment 100 is to be deployed. Such information is ascertained, for example, by monitoring the wave direction over time ahead of deployment. In the embodiment shown, the parallel planes of the mooring arrangements 108 are oriented perpendicular to the determined predominant wave direction. Such a conformation provides improved stability against surge forces resulting from, for example, waves acting on the platform 102. Embodiments will be appreciated, wherein the mooring arrangements 108 are oriented in any direction.

The mooring lines 110, 114 of the mooring arrangements 108 may comprise any suitable mooring line, such as a rope, chain or other suitable mooring means.

In some embodiments, it is possible to monitor and control the buoyant force provided by the buoyancy tanks, for example by removing or adding gas or fluid into the buoyancy tanks. It will be appreciated that alternative buoyancy means may be employed which provide this buoyant force.

Figure 2:
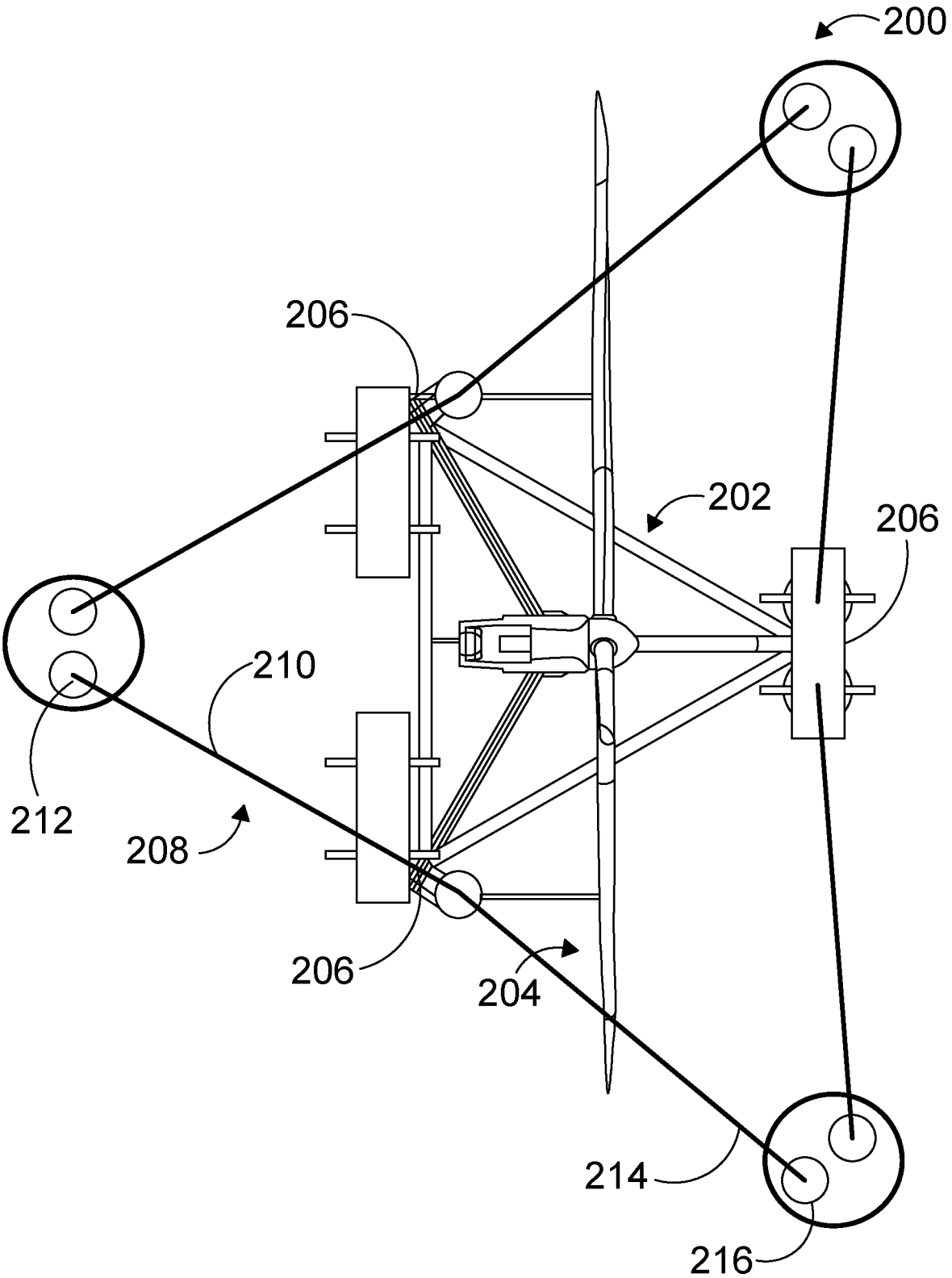
FIG. 2 depicts a plan view of an alternative embodiment of the invention of FIG. 1A, in use, having a mooring arrangement with intersecting planes, in accordance with an aspect of the present disclosure.

Turning now to FIG. 2, the embodiment 200 is shown having a platform 202 which is substantially the same as the platform 102 of FIG. 1A, having an upper portion supporting a wind turbine 204 and a submerged lower planar portion having three vertices 206. The vertices 206 of FIG. 2 each have a mooring arrangement 208 extending therefrom which, in a similar manner to the embodiment 100 of FIG.

1A, each have a first mooring line 210 and a second mooring line 214 affixed to corresponding anchor points 212, 216 positioned on the bed of the body of water. In the embodiment 200 of FIG. 2, the mooring lines 210, 214 of each mooring arrangement 208 form a triangle positioned in planes which intersect the planes of each other triangle formed by the other mooring arrangements. Collectively, the planes of the mooring arrangements 208 of the embodiment 200 shown form substantially the same shape of the platform 202, concentric with the platform 202, but arranged such that the sides thereof are positioned tangentially to the vertices 206 of the platform 202. The intersecting planes of the mooring arrangements 208 in the embodiment 200 shown therefore form internal angles at the intersects which sum to approximately $(n-2)\times180°$ (where "n" is the number of vertices 206 of the platform 202), which in the present case is 180°.

The intersecting nature of the planes of the mooring arrangements 208 of the embodiment 200 shown, preferably provides stability of the platform in a greater number of directions than the embodiment 100 shown in FIG. 1A. Therefore, the embodiment 200 of FIG. 2 may be suitable for deployment in areas experiencing highly variable wave and/or wind directions.

In the embodiment 200 shown, the mooring lines of adjacent mooring arrangements have individual anchor points. Embodiments will be appreciated, wherein the mooring lines of adjacent mooring arrangements share common anchor points.

Figure 3A:
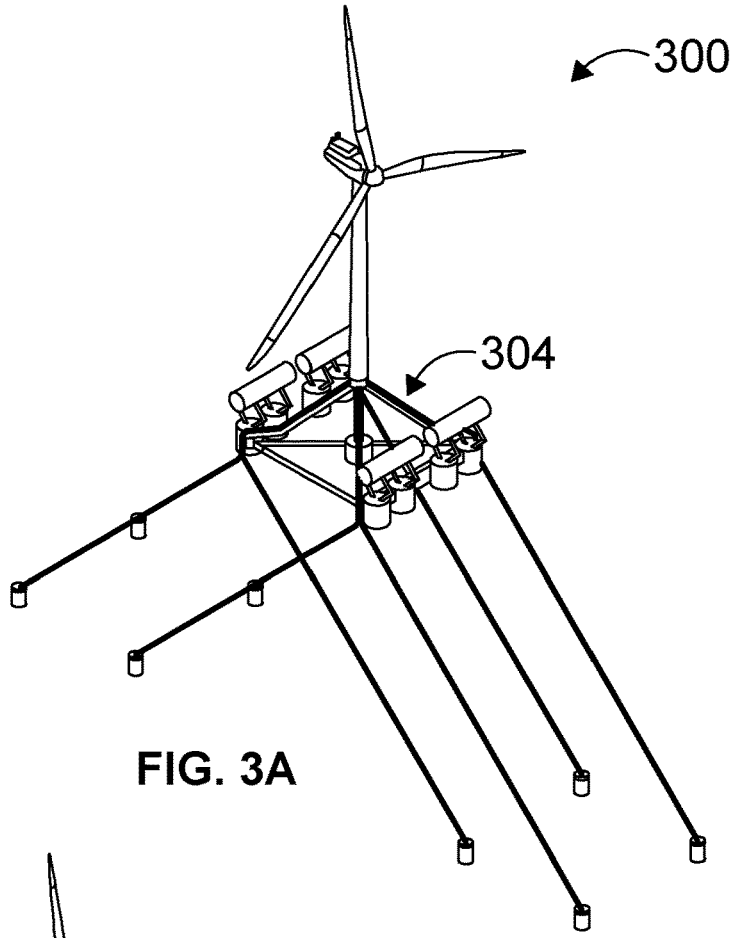
FIG. 3A depicts a perspective view of a further alternative embodiment of the invention of FIG. 1A having four vertices forming a square platform, in accordance with an aspect of the present disclosure.

Additional embodiments 300, 302 of a TLP in accordance with the first aspect are shown in FIG. 3A, which are substantially equivalent to the embodiment 100 of FIG. 1A, having mooring arrangements positioned in parallel planes, and wherein the corresponding platforms 304 have four vertices instead of three. The embodiments 300, 302 are substantially the same, with the orientation of the corresponding platforms being rotated about a central axis to provide a square formation in the embodiment 300 of FIG. 3A, and a diamond formation in the embodiment 302 of FIG. 3B.

Figure 4:
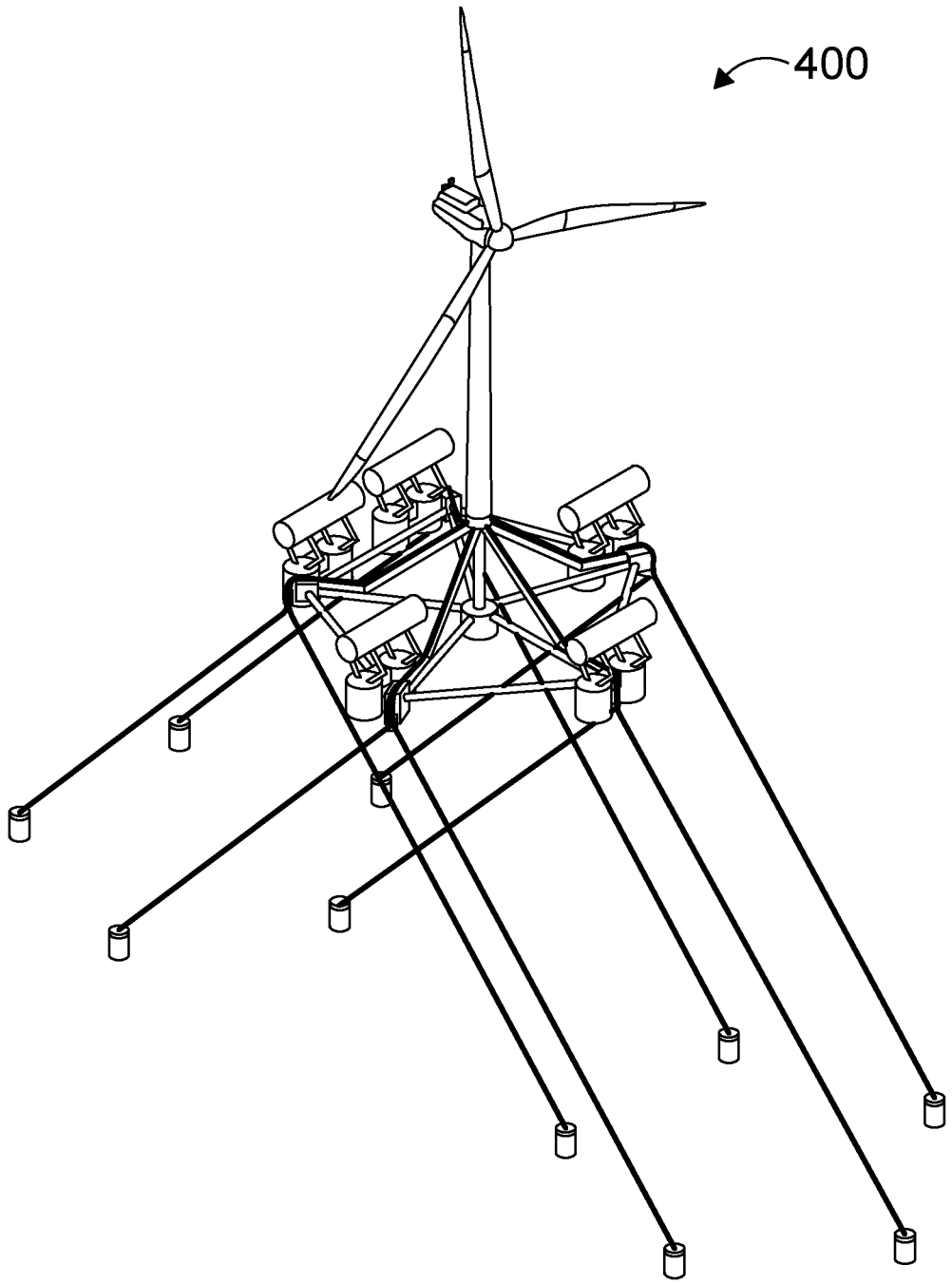
FIG. 4 depicts a perspective view of a further alternative embodiment of the invention platform of FIG. 1A having six vertices forming a hexagonal platform, in accordance with an aspect of the present disclosure.

A further embodiment 400 demonstrating a hexagonal platform is shown in FIG. 4, having six vertices, each with a corresponding parallel mooring arrangement.

Figure 3B:
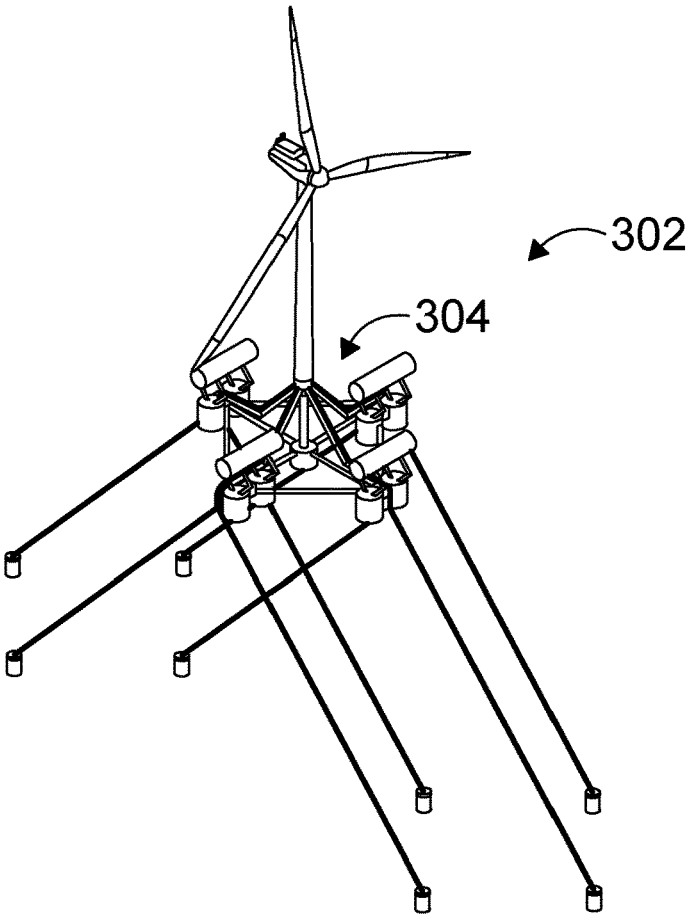
FIG. 3B depicts a perspective view of an alternative embodiment of the invention of FIG. 3A, wherein the platform has a diamond orientation relative to the mooring arrangement, in accordance with an aspect of the present disclosure.

Embodiments equivalent to those of FIG. 3A, FIG. 3B and FIG. 4 will be appreciated wherein the mooring arrangements are positioned in intersecting planes similar to the embodiment 200 of FIG. 2.

Figure 5A:
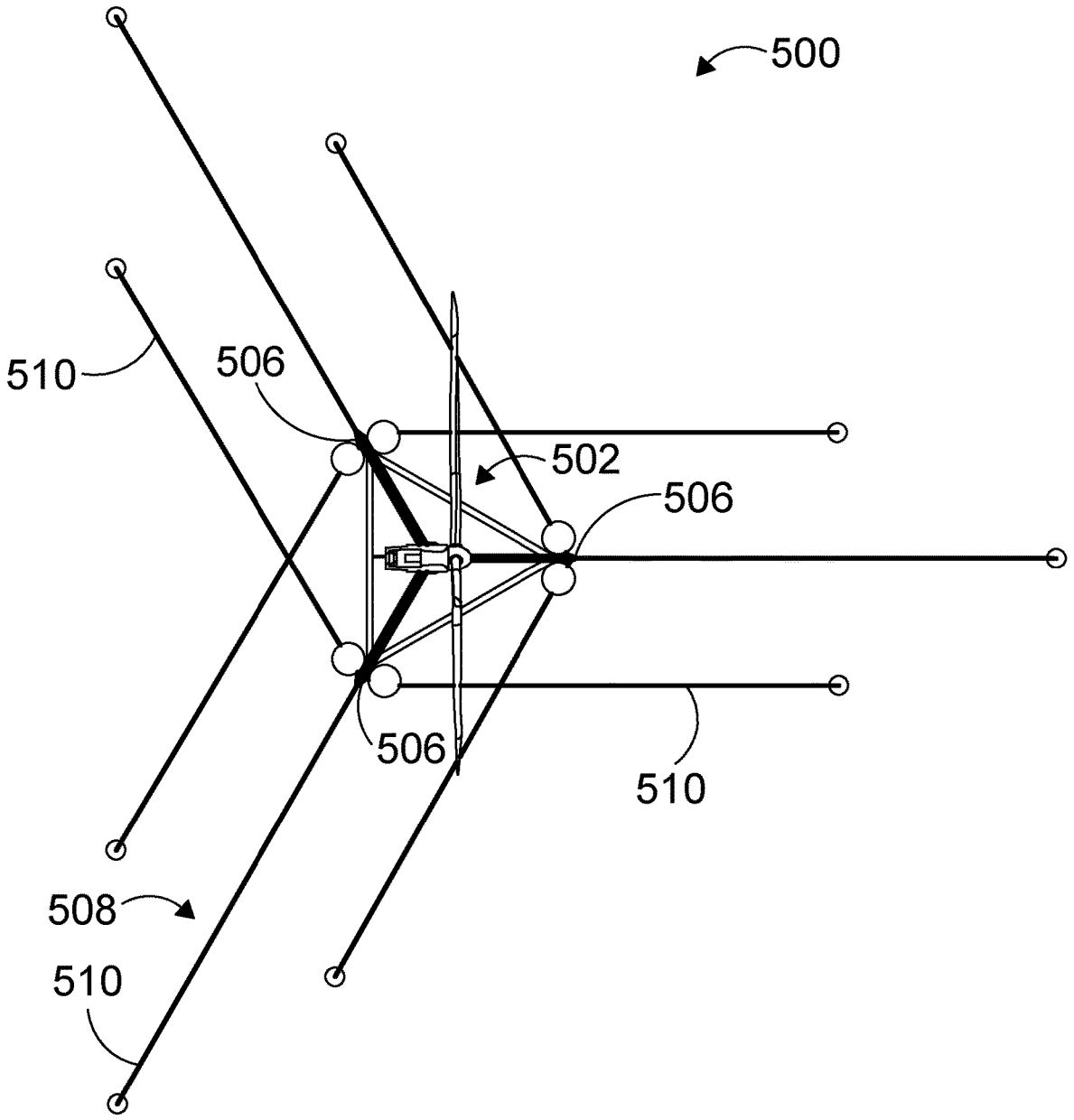
FIG. 5A depicts a plan view of a further alternative embodiment of the invention of FIG. 1A, wherein each mooring arrangement has three mooring lines, in accordance with an aspect of the present disclosure.
Figure 5B:
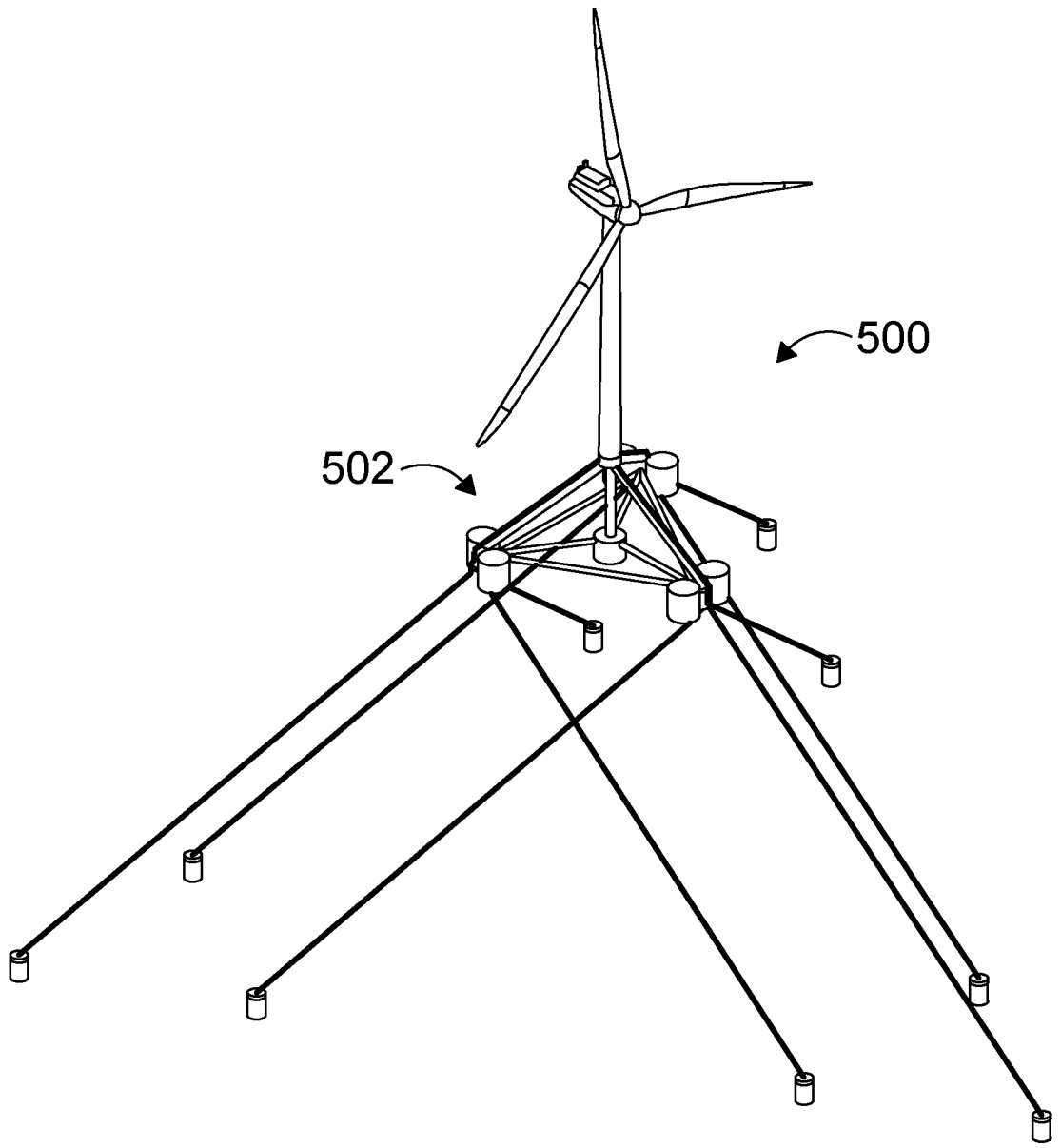
FIG. 5B depicts a perspective view of the embodiment of FIG. 5A, in accordance with an aspect of the present disclosure.

Referring to FIG. 5A and FIG. 5B, a further embodiment 500 is provided in accordance with the first aspect. In the embodiment 500 shown, a platform 502 is provided substantially as shown and described for FIG. 1A, but wherein each of the three vertices 506 of the platform 502 comprises a mooring arrangement 508 having three mooring lines 510. The mooring lines 510 of each mooring arrangement 508 cooperate to form triangles in planes parallel to those formed by other of the mooring arrangements, and additionally intersecting with those formed by the of the mooring arrangements. Such an arrangement provides particularly improved surge stability in a variety of directions.

The three mooring lines 510 of each mooring arrangement 508 share a common internal angle relative to the bed of the body of water, and together their anchor points describe a triangle shape. The centre point of the triangle shape formed by the anchor points of the three mooring lines 510 of each mooring arrangement 508 in the embodiment shown is vertically aligned with the corresponding vertex 506, and is specifically aligned with the centre of buoyancy of the vertex 506 provided by buoyancy members affixed thereto. Such an arrangement provides an optimal tension counteracting the buoyancy, while stabilising the platform against additional surge forces which may result in lateral offset of the platform.

Figure 6A:
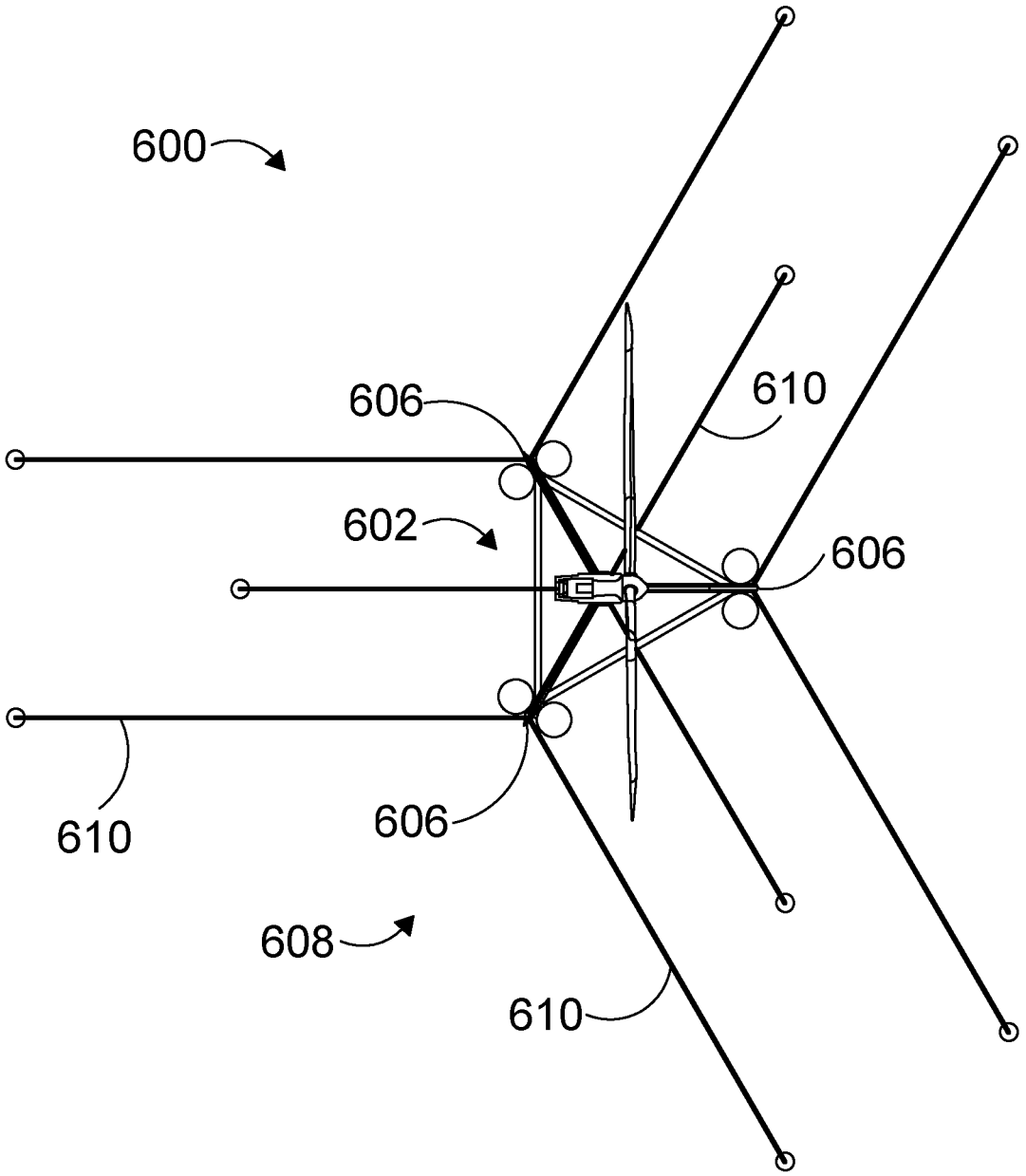
FIG. 6A depicts a plan view of an alternative embodiment of the invention of FIG. 5A, in accordance with an aspect of the present disclosure.
Figure 6B:
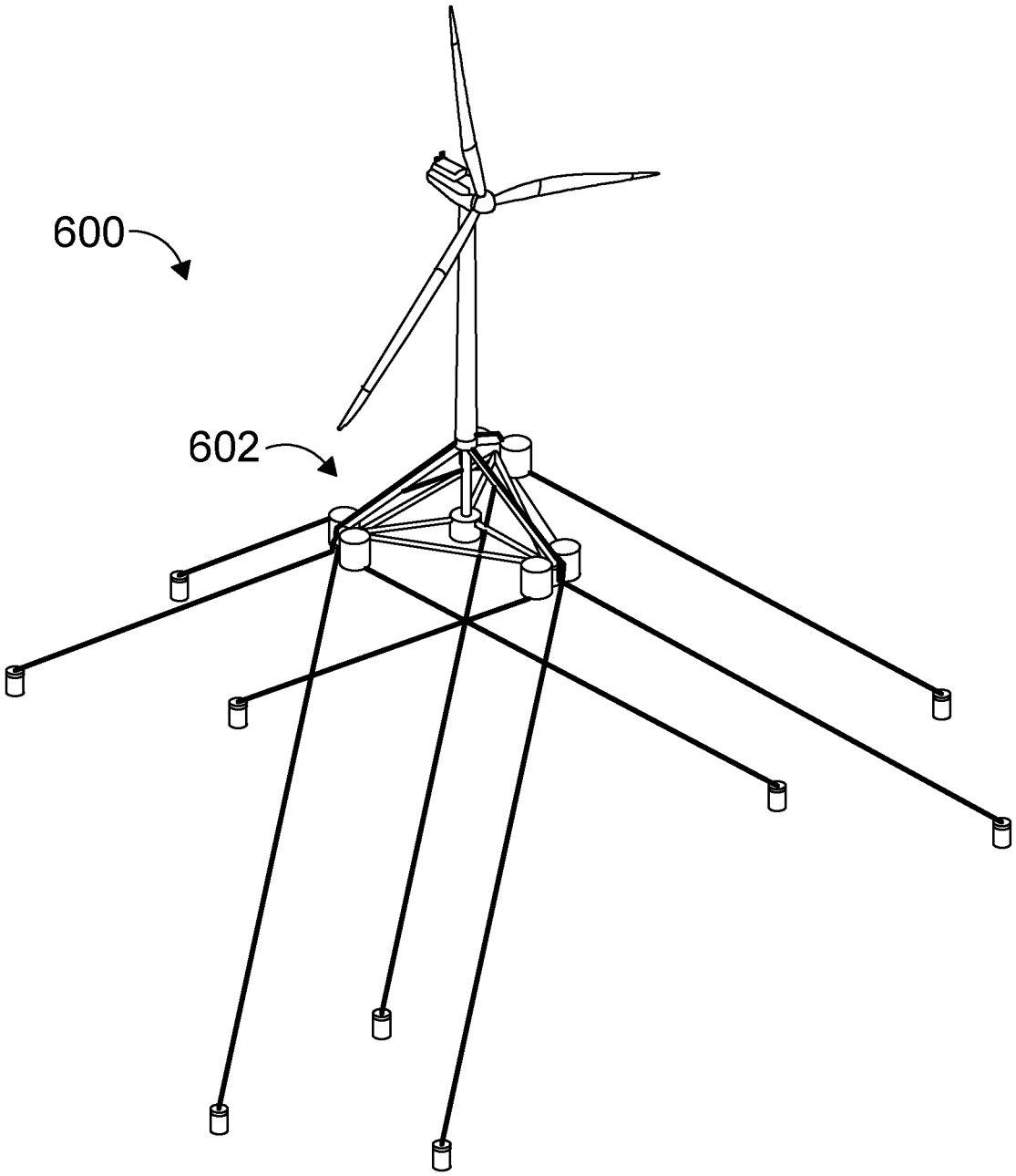
FIG. 6B depicts a perspective view of the invention of FIG. 6A, in accordance with an aspect of the present disclosure.

A further embodiment 600 is described in FIG. 6A and FIG. 6B, which is similar to the embodiment 500 of FIG. 5A and FIG. 5B and uses similar reference numbering, but having anchor points of each of the mooring lines of corresponding mooring arrangements positioned in a different location to those described in relation to FIG. 5A and FIG. 5B, while providing substantially the same benefits.

The present embodiments are described in relation to a polygonal platform having vertices. Embodiments will be appreciated, wherein substantially the same effect may be obtained by any suitable shape, such as a platform comprising a plurality of elongate structures extending away from a centre or central region of the platform, such as in a radial or radiating fashion, each elongate member having an end distal to the centre or central region forming a lateral extent comprising a mooring arrangement as described herein. It will be understood that the mooring arrangements may be provided by any suitable arrangement, for example lines directly affixed to stationary points on a frame of the platform, or arranged to be spooled using a winch. The spooling variety may be used where an adjustment of the length of the lines is desired, for example during deployment and to submerge the platform to the desired depth. There may be instances wherein the desired depth changes over time, such as for example due to a rising and falling sea level, or as a result in a change in sea conditions such as during a storm. In such instances a mooring arrangement having adjustable length may be desired. In such embodiments, the adjustment of the length of the mooring lines, and therefore the depth of submergence of the platform, may be independent of any capturing of renewable energy by a renewable energy capturing device mounted on the platform. Therefore, the adjustment of the depth may be performed without requiring any suspension of operation of the renewable energy capturing device, thus optimising energy capture. This may, for example, be favourable during storm conditions, during which time a large sea state may require the depth of the platform to be reduced in order to reduce lateral forces acting thereon by waves, but which provide maximum energy capture opportunity by, for example, a wind turbine or a wave energy capturing device mounted on the platform.

In some embodiments, the renewable energy capturing device comprises one selected from: a wave energy convertor system (WEC); a tidal energy convertor system; a wind energy convertor system. The WEC can in some embodiments comprise of any suitable type of WEC design, for example a point absorber, an oscillating wave surge absorber, or a submerged pressure differential absorber. In some embodiments, the renewable energy capturing device comprises one selected from the group comprising: a wave energy convertor; a tidal energy converter; and a wind turbine. The tidal energy converter may comprise any suitable tidal energy converter and may, for example, comprise a tidal turbine having a horizontal axis turbine or a vertical axis turbine. The wind energy converter may be any suitable wind energy converter and may for example comprise a wind turbine. In some embodiments, the renewable energy processing apparatus comprises a hydrogen electrolyser. Embodiments will be appreciated, wherein any suitable renewable energy processing apparatus is provided which is arranged to generate a secondary resource from energy harnessed and/or stored. In embodiments that comprise hydrogen generation, electricity may be generated by any renewable energy harnessing and/or converting apparatuses which may be attached to, affixed to, support on, or housed within the invention, which can then be used to generate hydrogen, singly or in combination.

As shown and described in relation to the depicted examples, in some embodiments, the platform may comprise a lower portion and one or more upper portions; the platform having a submerged in-use configuration, wherein the lower portion is positioned below the surface of the body of water and the upper portion is positioned above the surface of the body of water. When in the in-use configuration, the upper portion may be arranged to remain positioned above the surface of the body of water. It will be understood that the upper portion may therefore comprise a device or housing optimised for dry conditions, and therefore preferably remains above the surface of the body of water in-use. The housing may, for example, be a room housing controlling, operation or maintenance equipment. The upper portion of the platform may, in some embodiments comprise a renewable energy device such as a wind turbine mounted thereon.

In some embodiments, the centre of buoyancy of a vertex or lateral extent of the platform may be defined by a location on a first plane parallel to the platform, and a second plane perpendicular to the platform, wherein the mooring point is positioned proximate, or at, the location of the centre of buoyancy of the corresponding buoyancy member in at least one of: the first plane; the second plane. In some embodiments, the at least one mooring member is arranged to apply a tensioning force on a respective mooring point at which a mooring line communicates with the respective vertex or lateral extent, the tensioning force acting in a plane parallel to the second plane, and proximate to or coplanar with the second plane. The mooring point preferably provides the tensioning force in a plane parallel to a plane occupied by a buoyancy force acting upon the platform at the centre of buoyancy. The tensioning force applied at the mooring point by the mooring arrangement of a vertex or lateral extent therefore preferably counteracts the buoyancy force acting at the centre of buoyancy of the corresponding buoyancy member. The parallel and proximate, and preferably coplanar, nature of the counteracting forces provides optimal stability to the platform in use.

In some embodiments, the at least three vertices or lateral extents form outer extremities of the platform. Positioning the vertices or lateral extents (with or without the corresponding buoyancy members) at the outer extremities of the platform preferably confers optimal stability on the platform in-use due to the mooring arrangements. The at least three vertices or lateral extents may be positioned in a common plane parallel to a plane of the platform.

In some embodiments, the at least three vertices or lateral extents are substantially equidistant from a central axis of the platform and substantially equispaced around or about the central axis of the platform.

Further embodiments within the scope of the present disclosure may be envisaged that have not been described above, for example, there may be any combination of renewable energy convertors on the platform as described herein. One, multiple or all vertices or lateral extents may comprise a renewable energy convertor. The platform may comprise a number of non-buoyant vertices or lateral extents which do not comprise buoyancy members. These non-buoyant vertices or lateral extents may be aligned in the same horizontal plane as the buoyant vertices or lateral extents, or in an offset plane. These non-buoyant vertices or lateral extents may comprise renewable energy convertors. The platform may comprise a single body piece or may be assembled form a number of pieces. The disclosure is not limited to the specific examples or structures illustrated herein.

As may be recognized by those of ordinary skill in the art based on the teachings herein, numerous changes and modifications may be made to the above-described and other embodiments of the present disclosure without departing from the scope of the disclosure. The components of the guide system as disclosed in the specification, including the accompanying abstract and drawings, may be replaced by alternative component(s) or feature(s), such as those disclosed in another embodiment, which serve the same, equivalent or similar purpose as known by those skilled in the art to achieve the same, equivalent or similar results by such alternative component(s) or feature(s) to provide a similar function for the intended purpose. In addition, the platform may include more or fewer components or features than the embodiments as described and illustrated herein. Accordingly, this detailed description of the current embodiments is to be taken in an illustrative, as opposed to limiting of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, an invention that "comprises," "has," "includes," or "contains" elements possesses those one or more steps or elements, but is not limited to possessing only those one or more elements. Furthermore, a device or structure that is configured in a certain way is configured in at least that way, but may also be configured in ways that are not listed.

The disclosure has been described with reference to the preferred embodiments. It will be understood that the architectural and operational embodiments described herein are exemplary of a plurality of possible arrangements to provide the same general features, characteristics, and general system operation. Modifications and alterations will occur to others upon a reading and understanding of the preceding detailed description. It is intended that the disclosure be construed as including all such modifications and alterations.

What is claimed is:

1. A buoyant tension leg platform arranged to support a renewable energy capturing device when the platform is submerged in a body of water, the platform having at least three vertices or lateral extents, wherein each vertex or lateral extent is a region of the platform located about outer edges of the platform, the at least three vertices or lateral extents each having a mooring arrangement;

wherein each mooring arrangement comprises:

a first mooring line extending from a vertex or lateral extent of the at least three vertices or lateral extents to a first anchor point in communication with a bed of the body of water, the first mooring line extending at an acute angle relative to the bed; and a second mooring line extending from the vertex or lateral extent to a second anchor point in communication with the bed of the body of water, the second mooring line extending at the acute angle relative to the bed, such that each mooring arrangement of a corresponding vertex or lateral extent defines a separate triangle positioned on a separate plane, wherein each of the separate planes are spaced apart from, and parallel to, each other and extend upward from the bed of the body of water toward a surface of the body of water; and wherein an apex of the triangle formed at the corresponding vertex or lateral extent of each mooring arrangement is positioned vertically aligned with a center point of a side of the triangle tracking along the bed of the body of water between the first anchor point and the second anchor point.

2. The platform of claim 1, wherein each vertex or lateral extent of the platform has a corresponding mooring arrangement.

3. The platform of claim 1, wherein the first and second mooring lines of each mooring arrangement are positioned at 45° relative to the bed, and further positioned at 90° relative to one another.

4. The platform of claim 1, wherein the first anchor point and the second anchor point are positioned equidistant from a central axis of each mooring arrangement, the central axis extending vertically from the corresponding vertex or lateral extent of each mooring arrangement.

5. The platform of claim 1, wherein the planes are oriented perpendicular to a most common wave direction and/or a most common wind direction.

6. The platform of claim 1, wherein the mooring lines comprise a mooring line material, the mooring line material being at least one of a chain, a metal rope, a synthetic rope, and a dyneema rope.

7. The platform of claim 1, wherein the platform further comprises a buoyancy member positioned on or adjacent each vertex or lateral extent.

8. The platform of claim 7, wherein the buoyancy member is arranged to provide an adjustable buoyancy of the respective vertex or lateral extent.

9. The platform of claim 1, wherein each mooring arrangement is configured to secure the platform in a submerged position within the body of water.

10. The platform of claim 1, wherein the side of the triangle tracking along the bed of the body of water between the first anchor point and the second anchor point is a hypotenuse.

* * * * *